United States Patent [19]

Mead

[11] 4,282,694

[45] Aug. 11, 1981

[54] GRAIN BIN FLOOR SUPPORT SYSTEM

[75] Inventor: Harold C. Mead, Charles City, Iowa

[73] Assignee: Nixdorff Krein Industries, Inc., St. Louis, Mo.

[21] Appl. No.: 92,533

[22] Filed: Nov. 8, 1979

[51] Int. Cl.[3] ..... E04H 7/00

[52] U.S. Cl. ..... 52/508; 52/192; 34/233; 98/55

[58] Field of Search ..... 98/52, 53, 54, 55; 34/233, 239, 225, 237; 52/192, 800, 808, 810, 303, 262, 244, 508

[56] References Cited

U.S. PATENT DOCUMENTS

| | | | |
|---|---|---|---|
| 2,983,038 | 5/1961 | Johnson | 52/800 |
| 3,282,615 | 11/1966 | Darby | 52/800 |
| 3,426,445 | 2/1969 | Steffen | 52/192 |
| 3,538,668 | 12/1967 | Anderson | 52/808 |
| 4,009,520 | 3/1977 | Sakap | 34/233 |
| 4,037,527 | 7/1977 | Steffen | 34/233 |
| 4,073,110 | 2/1978 | Kennedy | 52/588 |
| 4,137,682 | 2/1979 | Tramper | 52/588 |

FOREIGN PATENT DOCUMENTS

| | | | |
|---|---|---|---|
| 13857 | 9/1881 | Fed. Rep. of Germany | 98/53 |
| 970453 | 1/1951 | France | 52/729 |
| 1353612 | 1/1964 | France | 52/729 |

*Primary Examiner*—James A. Leppink
*Assistant Examiner*—Henry E. Raduazo
*Attorney, Agent, or Firm*—Kalish & Gilster

[57] ABSTRACT

An improved grain bin floor support system utilizes a plurality of independent floor supports for supporting interlocking flooring elements. Each floor support has curvilinear lower and upper rails, the lower serving as a base member for bearing against a subfloor or other supporting surface. Each support has plural spacers which extend between the upper and lower rails to maintain them in spaced, parallel relationship. The lower rail or base member defines a curvilinear path on the supporting surface. Similarly, the upper rail supports the flooring elements along a curvilinear path coincident with that established by the base member.

9 Claims, 10 Drawing Figures

GRAIN BIN FLOOR SUPPORT SYSTEM

BACKGROUND AND SUMMARY OF THE INVENTION

This invention relates to grain bin structures and more particularly to an improved support for grain bin floors.

In recent years, grain bins have often been constructed with a perforated floor defining a surface for supporting corn or other grain to be dried to a safe moisture content for long term storage. The perforated floor surface is positioned a few inches above a concrete slab or other support surface and with air being permitted to flow into the resultant space so that it may rise and circulate through the grain.

Because of the weight of the grain, the perforated flooring must be supported at intervals by strong load bearing structure. Concrete blocks have sometimes been used for this purpose, as in Steffen U.S. Pat. No. 2,818,009. Other support structures of an interfitting modular block type are disclosed in Pollock U.S. Pat. No. 3,979,871. Yet another floor support of a folded wire mesh type has been proposed in Steffen U.S. Pat. No. 3,426,445, being adapted to support ordinary wood planks which serve as joists for the perforated flooring material. Modular steel floor supports are proposed in Steffen U.S. Pat. No. 3,638,331 and Kennedy U.S. Pat. No. 4,073,110 discloses floor support legs of folded metal, being flanged to interlock with adjacent legs, as well as having slots for receiving box-like structural elements of perforated, flange-interlocking flooring material.

Among some of the disadvantages of such prior art constructions may be noted lack of strength, cumbersomeness in installation and/or transporting, high materials and manufacturing costs; awkwardness in use and inability to be oriented beneath the grain bin flooring to best possible effect, such as where grain weight may be greatest, or so as to permit an auger to be extended beneath the bin in the airspace occupied by the supports. Further, some kinds of supports have restricted air flow within such air space.

An object of the invention is the provision of an improved grain bin floor support system, and particularly such a system having an advantageous new type of floor support.

Other objects of the invention include the provision of such a new floor support which is extrinsically strong and resistant to bending or deformation; which can support great weights; which will stand by itself without extrinsic support or requiring contact with other supports; which allows air to circulate through it very freely; and which provides contact with a grain bin floor in such manner that the floor has increased strength and resistance to sagging or bending.

Still another object of the invention is the provision of such a floor support system wherein flooring sections and the individual floor supports effectively interlock for facilitating construction and installation, and for achieving still greater strength.

Another object of the invention is the provision of such a new floor support which is easily oriented beneath a grain bin floor in various desirable ways and which conduces to the placement of an auger or the like in the air space beneath the bin.

Other objects of the invention include the provision of such a new floor support which is easily manufactured of strong low-cost materials so that it may be inexpensively sold; and which is rugged, long-lasting and most reliable in use.

Other objects and features will be in part apparent and in part pointed out hereinbelow.

DESCRIPTION OF THE PREFERRED EMBODIMENT

Figure 1:
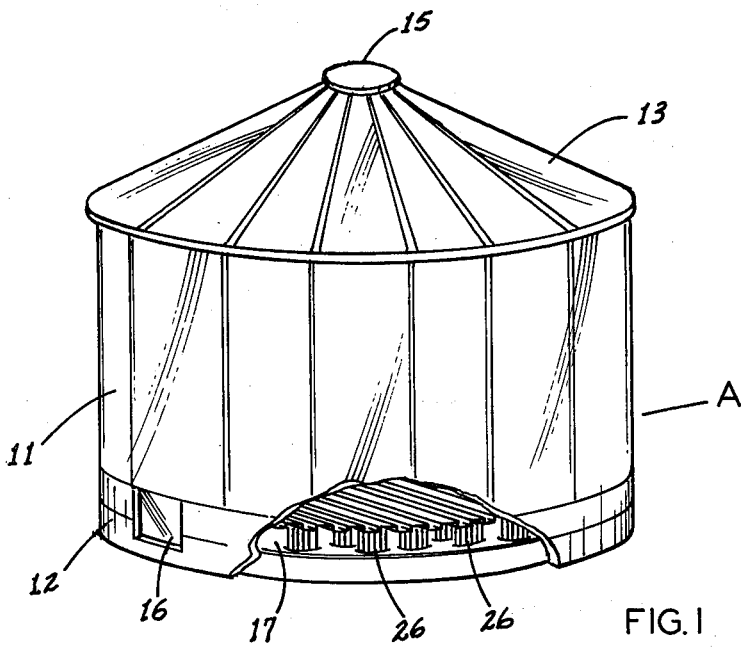
FIG. 1 is a perspective view of a grain bin with portions of it being cut away to illustrate a new floor support system constructed in accordance with and embodying the present invention.

Referring now to the drawings, there is illustrated generally at reference character A a storage bin of the type containing grain for the purpose of drying the same, as through use of an air heating unit (not shown) which may be connection to the storage bin. Said bin is of a round shape in plan, having a generally cylindrical side wall 11 which extends vertically upward from a foundation 12. A sloped roof 13 of the bin has a cap 15 which covers a vent for permitting flow of air from inside the bin to outside.

Foundation 12 is provided with an opening 16 through which heated air under pressure from the abovementioned air heater may be supplied or through which a grain auger may be inserted for withdrawing grain from the bin, if the latter is provided with flooring suited for permitting grain to be received by an auger, or otherwise permitting access to an air space 17 defined between a floor 19 of the foundation and a subfloor or flooring surface 20 supporting the grain to be stored within the bin.

If desired, a further concrete layer 22 may be provided below foundation floor 19 for providing a moisture barrier.

Bin floor 20 is constituted by a plurality of joined metal plates 23 which are of a perforated metal character, having perforations in the form of narrow slots through which air is freely permitted to circulate upward from compartment 17 and through the grain supported on bin floor 20. In accordance with the invention, flooring elements or sheets 23 are supported by a plurality of individual floor supports 26.

Figures 8, 9:
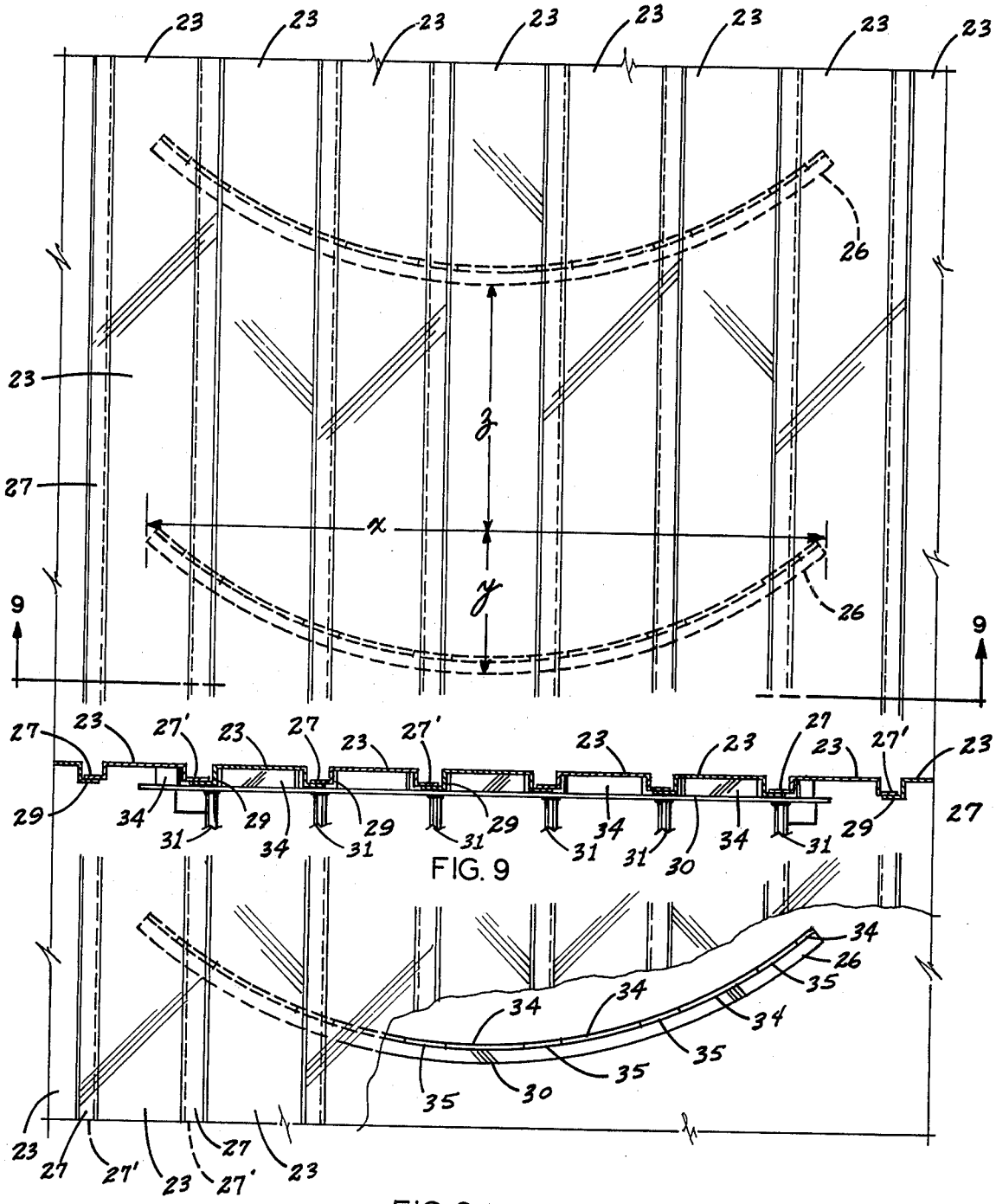
FIG. 8 is an enlarged plan view of portions of grain bin flooring illustrating its support by the new supports of the first embodiment, and with flooring being cut away to show such a support.
FIG. 9 is a transverse sectional view taken on line 9—9 of FIG. 8 to illustrate interengagement of flooring sections and the new support.

Referring to FIGS. 8 and 9, said sheets 23 of flooring material each have offset flanges 27,27' along the sides thereof which are overlapped to provide an interfitting relationship of adjacent sheets wherein the overlapped flanges of the adjacent sheets define a downwardly extending channel of box-like girder form extending longitudinally between each adjacent two sheets of flooring material. Said channels are in the nature of joists of the floor and are parallel and evenly spaced across the width of the floor. The new floor supports 26 are adapted to be placed in an assembly for supporting bin floor 20 by engagement of said channels or joists 29.

Figure 2:
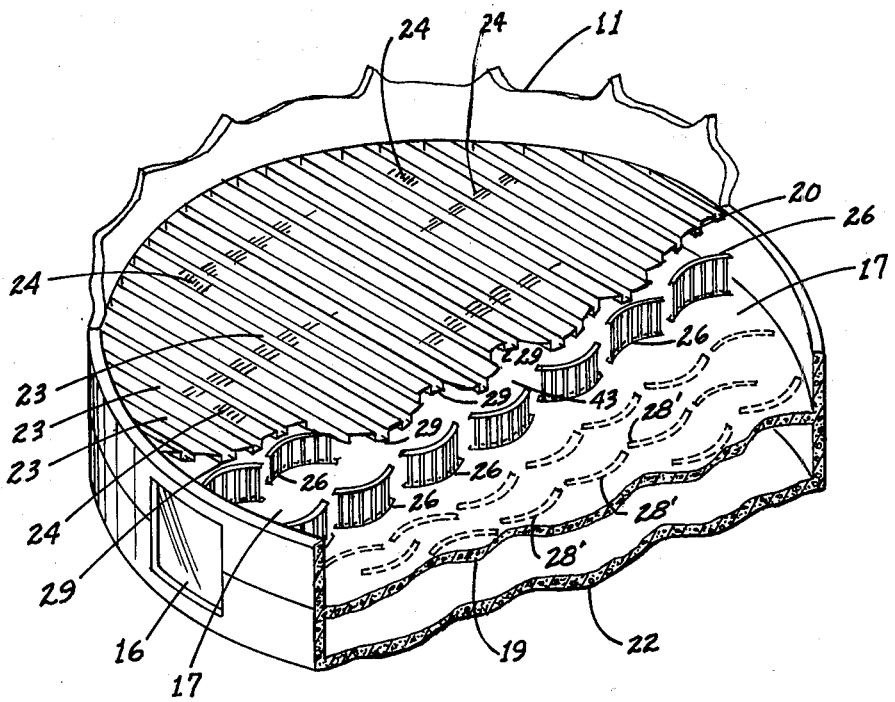
FIG. 2 is an enlarged fragmentary perspective view of a base of the bin, portions thereof being cut away to illustrate flooring members and the manner of their support by the new floor supports, as well as depicting various desirable orientations of the new floor supports.
Figure 3:
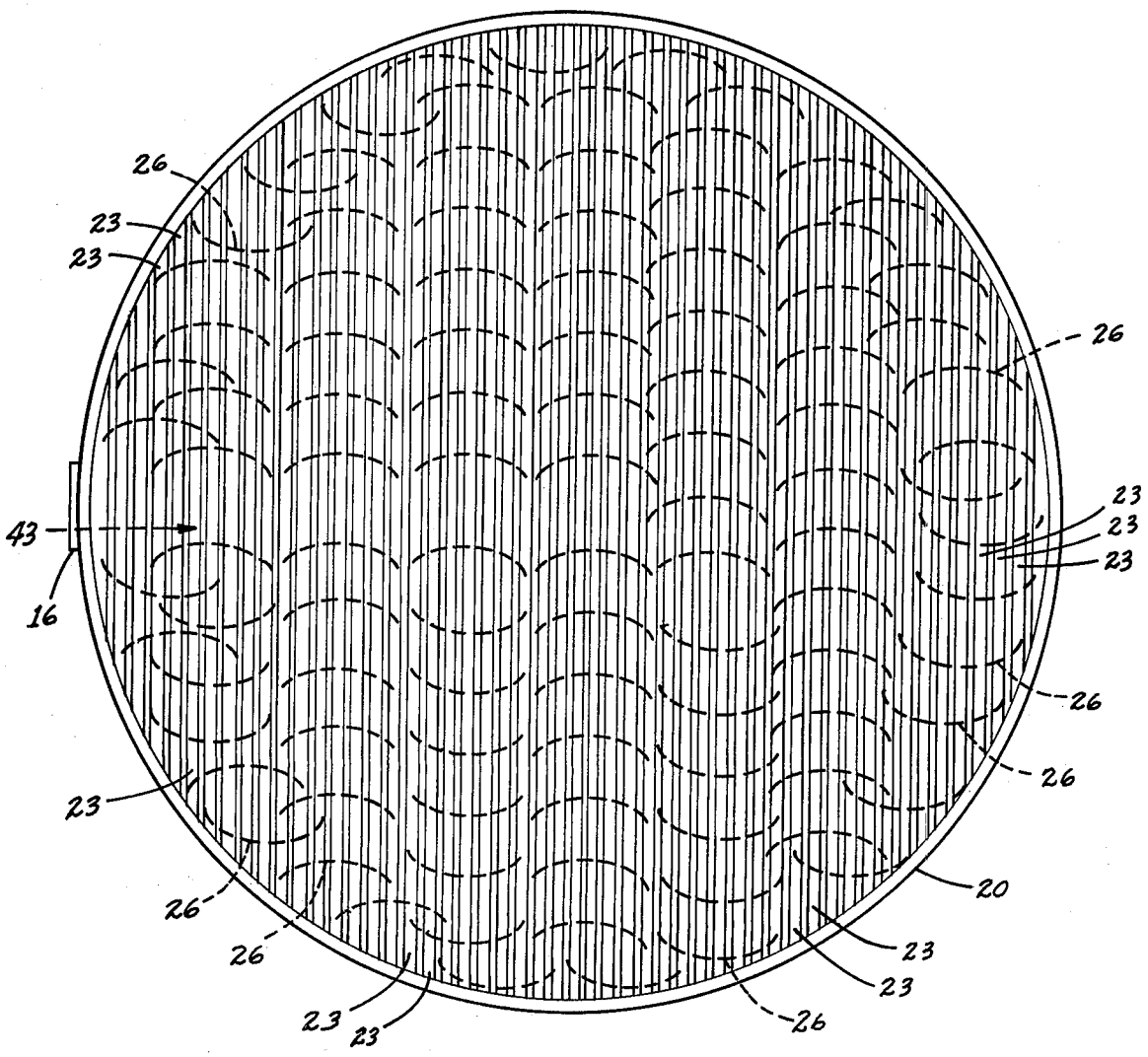
FIG. 3 is a plan view of grain bin flooring as it is supported by the new supports, the placement of which is indicated by dashed lines.

Referring to FIGS. 2 and 3, a plurality of the individual floor supports 26 are oriented beneath the sheets 23 of flooring material in a pattern, as depicted particularly in FIG. 3, for evenly supporting the load across the floor which may be produced by the weight of many thousands of bushels of grain within bin A.

Figure 4:
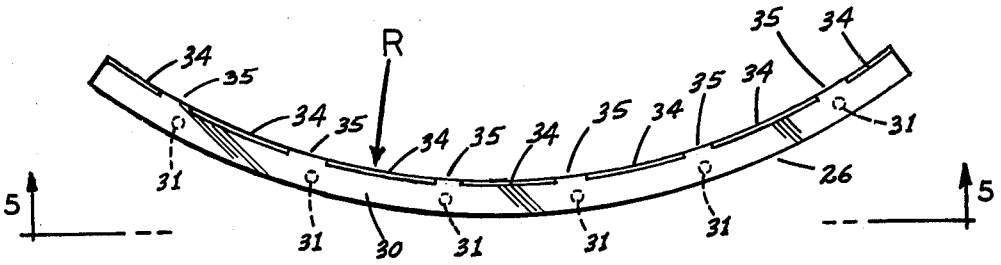
FIG. 4 is a top plan view of one embodiment of the new floor support.
Figure 5:
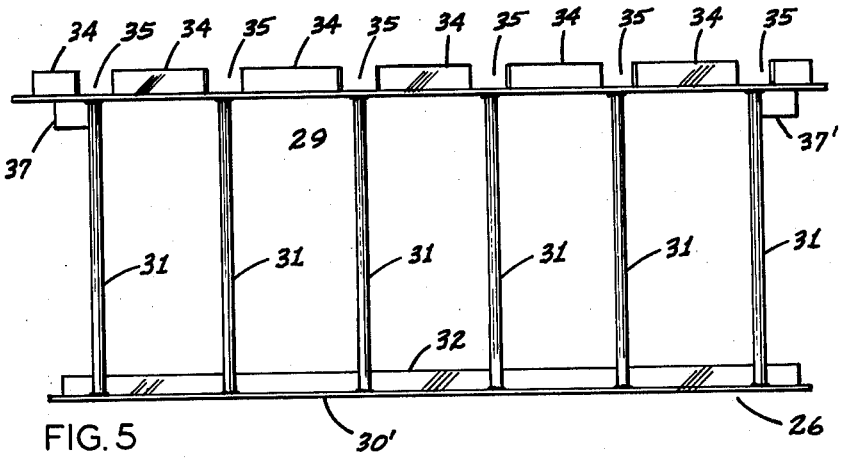
FIG. 5 is a side elevational view of the floor support of FIG. 4, as viewed on line 5—5 of FIG. 4.

Additionally referring to FIGS. 4 and 5, a first embodiment of floor support 26 is illustrated. Said support comprises lower and upper rail members 30,30' each of which is in plan view (as seen in FIG. 4) in the form of a thin flat strip of metal of narrow curvilinear form. Steel is preferred. Lower member 30' serves as a base for bearing against a supporting surface such as the floor 19 of the bin foundation and defines thereon a curvilinear path as shown at 38' in FIG. 2.

The upper and lower members are spaced apart by several steel rods 31 which are welded at their opposite extremities to the upper and lower members 30,30' as indicated, whereby the rods serve as spacers for transmitting load from the upper member 30 to the lower member 30' and at the same time maintaining said members 30,30' in spaced, parallel relationship. The upper surface of upper member 30 is adapted to bear against and contact the channels or joists 29 defined by the interengaged flooring members.

For stiffening purposes, as for enhancing resistance against twisting, lower member 30' is provided with an upstanding, vertical web 32 extending along at least one side edge thereof and substantially its entire length, being integrally joined thereto. In this regard, rail 30' and its upstanding web 32 may together be constituted by L-shaped channel section suitably bent into the desired curvilinear configuration, or alternatively web 32 may be welded to the steel member 30'.

In the embodiment shown, upper member 30 is provided along one edge with a plurality of vertical web sections spaced at intervals along portions of one side of the rail, as shown at 34. As will be noted, the individual web sections increase in length from the center of the rail toward its outer extremity so that there is provided between each adjacent pair of web sections 34 a space 35 for receiving the box-like joists 29 of the flooring sections. In FIG. 5, it is seen that the spacing of said notches 35 as projected in side elevation is even. Thus, the notches are adapted to be coincident with the joists 29 when the floor supports extend transversely to the flooring joists, as shown in FIG. 8. Each such notch 35 is of width only slightly greater than the width of each joist 29 of the flooring section whereby there may be achieved a rather secure interfitting relationship of the joists 29 within the respective notches 35 (See FIG. 9). Also in FIG. 9, it is apparent that the web sections 34 are of height slightly less than the depth of the box-like girders or joists 29 so that the latter are actually supported upon rail 30 within each notch or recess 35. Preferably, as demonstrated in FIG. 5, the vertical support rods 31 have their points of securement to rail 30 in the region between each adjacent pair of web sections 34 so that the greatest amount of weight bearing potential is provided intermediate the notches 35 at this point.

For further reinforcement of the embodiment of FIGS. 4 and 5, short depending webs 37,37' are provided at opposite ends of the floor supports and welded to rail 30 and to the adjacent vertical rod 31, thereby providing increased stiffening and resistance of the floor support against warping or skewing under load.

Figure 6:
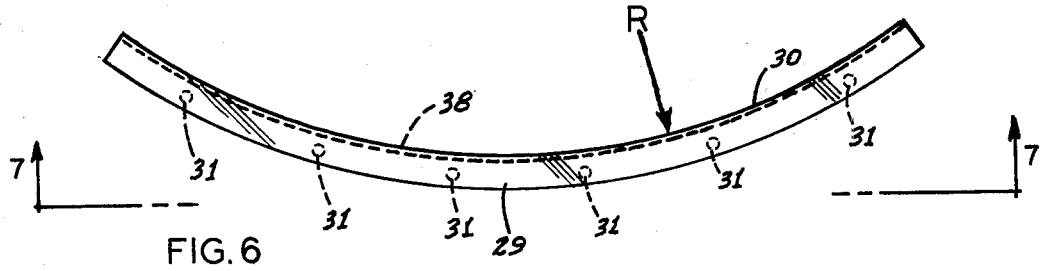
FIG. 6 is a top plan view of an alternative embodiment of the new floor support.
Figure 7:
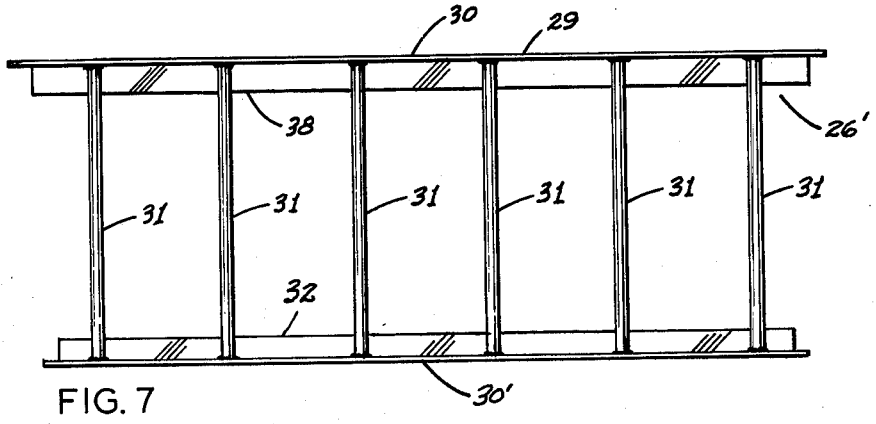
FIG. 7 is a side elevational view of the latter, as viewed on line 7—7 of FIG. 6.

In the embodiment demonstrated in FIGS. 6 and 7, such being identified at 26', lower and upper rail members 30,30' are provided as before and with lower rail 30' having an upstanding vertical flange 32 along its length for stiffening purposes. Vertical rod supports 31, as before, maintain the spacing between the upper and lower members 30,30', respectively. However, upper member 30 is provided with a downstanding vertical web 38 extending along at least one side edge, being integrally enjoined to rail 30 for providing increased stiffening thereof for consequent resistance of rail 30 against being bent downwardly or deformed by the weight of the box-like girders 29 of the floor elements. Since it does not provide an interlocking interengagement with such girders or joists, embodiment 26' can be freely moved about in the space beneath the flooring for most convenient and optimum placement to provide load bearing capabilities. On the other hand, embodiment 26, with its upstanding web sections 35, provides interengagement with the box-like girder structure of the flooring members to effectively provide an interlocking or interfitting relationship with the said girders for increased rigidity and resistance against shifting.

Each embodiment provides advantages not obtainable with prior art floor supports and such is demonstrated in part by reference to FIG. 8. Since each floor support 26 of the invention shown therein is of a free-standing configuration, it may be placed more readily in a desired location without concern about tipping. Further, each floor support provides an increased area of actual support of the overlying floor members and such area having a breadth x and depth y. The result of the curvilinear configuration is also to provide intrinsically closer positioning of adjacent floor supports 26 in that there is a reduced distance z between the middle extremity of one floor support and a chord drawn between the end points of an adjacent floor support. Such advantage is not achievable in the prior art construction demonstrated in FIG. 10.

Figure 10:
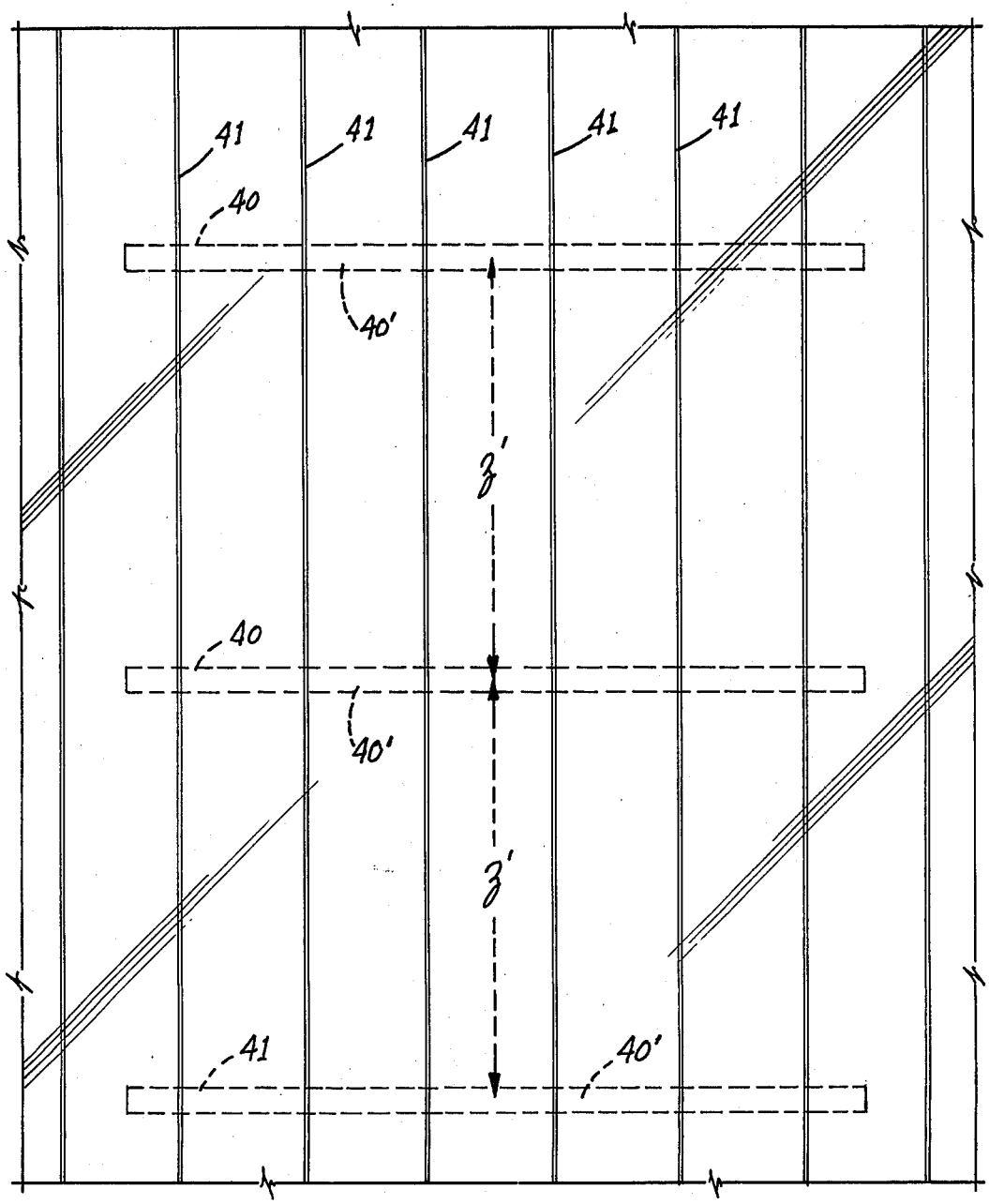
FIG. 10 PRIOR ART
FIG. 10 is a view similar to FIG. 9 but illustrating a prior art arrangement for supporting floor members.

In FIG. 10, three conventional floor supports 40 are illustrated for supporting a plurality of flooring elements having joists as indicated at 41. As will be understood, said floor supports 40 may be of conventional sawhorse-type configuration or other previously known linear supports of the type utilized in the prior art providing an upper surface 40' upon which the floor joists 41 are permitted to rest for being supported thereby. As will be apparent, however, the use of such conventional supports by virtue of their linear configuration means that the closest spacing between two adjacent floor supports is a dimension z' which is substantially greater than the spacing z shown in FIG. 8 achieved where the same number of supports of the invention are utilized.

Furthermore, the open structure of the new floor support does not impede movement of air therethrough, the only resistance to air being the vertical support member 31 and any stiffening flanges such as those indicated at 32,38. Hence, air may flow quite freely through the floor support and move unencumbered through the space 17 beneath the bin flooring 20. Also, air can circulate upward through the apertures 23 therein and through the grain contained within the bin in a much more unencumbered, unobstructed way than has heretofore been possible.

The configuration of the new floor supports also permits their placement at an optimum location for facilitating other usage of the space 17 beneath the bin flooring 20. In FIG. 2, the floor supports 26 are shown aligned with respect to the opening 16 in the bin foundation so that a corridor 43, in effect, is provided. A grain auger may be extended into this corridor if desired. Or, access is made available for the running of electrical wires, gas lines and so forth without their being interfered with by the new floor supports.

The curvilinear configuration of the new floor supports also permits them to be oriented so that the curvatures of adjacent supports may be all the same, or interchanged as desired, or alternated. For example, in FIG. 3, numerous floor supports 26 are shown opening in one direction while others open in the opposite direction. Further, the curvature of the supports permits them to be placed very close to the outer periphery of the bin floor 20 if such is desired.

Geometrically, the preferred configuration of each floor support is such that each of the rails and vertical support rods lie in an imaginary surface of curvature and with the rails lying parellely in said surface. Said surface of curvature preferably is of constant radius R, as depicted in FIGS. 4 and 6. But, it is possible for the curvature of radius to vary along the length of the floor support, as for achieving a parabolic configuration, etc.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed and desired to be secured by Letters Patent is:

1. For use with a storage bin for storing grain or the like, an improved floor support system comprising a plurality of flooring elements jointly cooperable for providing a generally horizontal grain bin floor and a plurality of independent floor supports arranged in an assembly for supporting said floor, each floor support comprising a curvilinear lower rail serving as a base member formed for bearing against a supporting surface and defining thereon a curvilinear path, an upper rail member of curvilinear configuration like that of said lower rail, a plurality of load bearing spacers extending between said lower and upper rails for maintaining the latter in spaced, parallel relationship, said upper rail bearing against and contacting said flooring elements in a curvilinear path coincident with the curvilinear path defined on said supporting surface, said spacers transmitting load from said upper rail to said lower rail, said upper and lower rails each comprising a relatively long, thin, flat strip of structural metal, each said strip in plan being of narrow curvilinear form.

2. An improved floor support system according to claim 1, wherein said spacers are each individually of load bearing configuration for transmitting load vertically from upper rail to said lower rail, each of said spacers being an elongated element extending in lengthwise, vertical relationship between said upper and lower rails, each said element at its opposite ends being rigidly secured to said rails.

3. An improved floor support system according to claim 2 wherein numerous of said spacers extend between each said upper and lower rail, said spacers being located at spaced intervals along said upper and lower rails.

4. An improved floor support system according to claim 3 wherein said spacers of each floor support comprises a plurality of metal rods welded at opposite ends to said rails, said rails being also of weldable metal, said rods being parallel with respect to one another.

5. For use with a storage bin for storing grain or the like, an improved floor support system comprising a plurality of flooring elements jointly cooperable for providing a generally horizontal grain bin floor and a plurality of independent floor supports arranged in an assembly for supporting said floor, each floor support comprising a curvilinear lower rail serving as a base member formed for bearing against a supporting surface and defining thereon a curvilinear path, and upper rail member of curvilinear configuration like that of said lower rail, a plurality of load bearing spacers extending between said lower and upper rails for maintaining the latter in spaced, parallel relationship, said upper rail bearing against and contacting said flooring element in a curvilinear path coincident with the curvilinear path defined on said supporting surface, said spacers transmitting load from said upper rail to said lower rail, said lower rail having an upstanding, vertical web extending along at least one edge of said rail and substantially the length of said rail, said rail and web being integrally joined for stiffening said rail.

6. For use with a storage bin for storing grain or the like, an improved floor support system comprising a plurality of flooring elements jointly cooperable for providing a generally horizontal grain bin floor and a plurality of independent floor supports arranged in an assembly for supporting said floor, each floor support comprising a curvilinear lower rail serving as a base member formed for bearing against a supporting surface and defining thereon a curvilinear path, an upper rail member of curvilinear configuration like that of said lower rail, a plurality of load bearing spacers extending between lower and upper rails for maintaining the latter in spaced, parallel relationship, said upper rail bearing against and contacting said flooring element in a curvilinear path coincident with the curvilinear path defined on said supporting surface, said spacers transmitting load from said upper rail to said lower rail, said upper rail having a downstanding vertical web extending along at least one edge of said rail and substantially the length of said rail, said rail and web being integrally joined for stiffening said rail.

7. An improved floor support system according to claim 1 wherein said rails and said spacers together define an imaginary surface of curvature with said rails lying parallely in said surface, said surface of curvature being characterized by a constant radius.

8. An improved floor support system according to claim 1 wherein said spacers are configured to permit free movement of air through the area bounded by the upper and lower rails of each floor support, said flooring material comprising sheets of perforated flooring material to permit free movement of air also through said flooring, whereby air may be more effectively circulated within grain or the like within said bin by circulation of air beneath said flooring.

9. For use with a storage bin for storing grain or the like, an improved floor support system comprising a plurality of flooring elements jointly cooperable for providing a generally horizontal grain bin floor and a plurality of independent floor supports arranged in an assembly for supporting said floor, each floor support comprising a curvilinear lower rail serving as a base member formed for bearing against a supporting surface and defining thereon a curvilinear path, an upper rail member of curvilinear configuration like that of said lower rail, a plurality of load bearing spacers extending between said lower and upper rails for maintaining the latter in spaced, parallel relationship, said upper rail bearing against and contacting said flooring element in a curvilinear path coincident with the curvilinear path defined on said supporting surface, said spacers transmitting load from said upper rail to said lower rail, said floor elements comprising sheets of flooring material having offset flanges along the sides thereof for providing an interfitting relationship with similar of other sheets of flooring material, said flanges being each downwardly offset from the plane of said sheets of material for defining a downwardly extending channel of box-like girder form between each two sheets of flooring material for being engaged by an upper rail of the respective floor supports, said channels being parallel and evenly spaced apart across the width of said floor, said upper rail having a plurality of upstanding vertical web sections spaced at intervals along at least portions of at least one edge of said rail, the height and spacing of said vertical web sections along said rail being such that said sheets of flooring material are supported by engagement of the upper rail against said box-like girders, and said vertical web sections are positioned between said box-like girders, said vertical web sections increasing in length from the center of said floor support upper rail toward its outer extremities, the spacing along said upper rail between adjacent vertical web sections corresponding to, and being slightly greater than, the width of each said box-like girder, whereby a secure interfitting relationship between said girders and said floor supports is attained, and whereby a plurality of said girders are supported by a single floor support but along said curvilinear path thereby to effectively increase the area of support provided by each floor support.

* * * * *